US005287791A

United States Patent [19]

Chaboki et al.

[11] Patent Number: 5,287,791

[45] Date of Patent: Feb. 22, 1994

[54] PRECISION GENERATOR AND DISTRIBUTOR DEVICE FOR PLASMA IN ELECTROTHERMAL-CHEMICAL GUN SYSTEMS

[75] Inventors: Amir Chaboki, Minneapolis; James P. Warren, Coon Rapids, both of Minn.

[73] Assignee: FMC Corporation, Chicago, Ill.

[21] Appl. No.: 902,349

[22] Filed: Jun. 22, 1992

[51] Int. Cl.[5] ..... F41B 6/00

[52] U.S. Cl. ..... 89/8; 102/202.700; 102/202.800; 102/472

[58] Field of Search ..... 89/8; 102/202.5, 202.7, 102/202.8, 209.9, 472

[56] References Cited

U.S. PATENT DOCUMENTS 3,143,069 8/1964 Ostrow ..... 102/202.7
4,895,062 1/1990 Chryssomallis et al. ..... 89/8
5,072,647 12/1991 Goldstein et al. ..... 89/8

FOREIGN PATENT DOCUMENTS 2355255 5/1975 Fed. Rep. of Germany ..... 102/472
669508 10/1964 Italy ..... 102/202.5
6679 4/1904 United Kingdom ..... 102/202.8

*Primary Examiner*—Stephen C. Bentley

[57] ABSTRACT

The method and apparatus disclosed herein relates to a precision generator and distributor device for plasma and plasma discharge arc as it particularly applies to electro-thermal chemical gun system operations. A self-adjusting filament erodably controls the formation, energy content, consistency and dimension of a plasma arc in a capillary. Specifically, in cooperation with radially and longitudinally formed perforations in the capillary wall, the filament enables the distribution of a predetermined amount of plasma and plasma-ignited chemical fluid into segments and regions of a combustible chemical in a contiguous chamber to thereby control combustion and increase piezometric and ballistic efficiency of the gun system. More specifically, the filament enables the creation of a plasma arc that is sustainable, definite and consistent and one which yields high pressure and temperature at a reduced ohmic resistance for a given power supply.

18 Claims, 10 Drawing Sheets

PRECISION GENERATOR AND DISTRIBUTOR DEVICE FOR PLASMA IN ELECTROTHERMAL-CHEMICAL GUN SYSTEMS

BACKGROUND OF THE INVENTION

1. Field of the Invention

This invention relates to a precision generator and distributor device for plasma in electro-thermal chemical gun systems. In particular, a self-adjusting filament provides a controlled amount of high temperature and high pressure plasma in a capillary in cooperation with perforations in the capillary wall and nozzles in partition walls to enable temporal and spatial distribution of the plasma into a combustible chemical mass to thereby control combustion and achieve high ballistic and piezometric efficiencies.

2. Description of the Prior Art

U.S. Pat. No. 4,711,154 Chrysomallis et al discloses a pressure amplification system in which plasma is created by exploding or evaporating a fuse wire in a capillary. Unlike the present invention, this prior art starts the plasma instantaneously and as a result high ohmic resistance develops in the capillary. Such high ohmic resistance, encountered in the early stages of plasma development, is undesirable because it limits the geometric dimensions and energy content, i.e. the length, width, thickness and energy per unit length of the plasma arc for a given power supply. Further, fuse wires produce considerable shock waves which are propagated by a burning propellant or chemical mass and results in undesirable pressure spikes in the combustion chamber.

Similarly, U.S. Pat. No. 4,895,062 Chrysomallis et al discloses an impulse propulsion gun system wherein high pressure and temperature are created in a gun breech block with initial ignition provided by a plasma source. The plasma is generated in a capillary using a fuse wire which evaporates under the influence of a high voltage and current input. The plasma arc and discharge in this prior art are developed instantaneously and depend upon the consumption of the fuse wire by the high voltage and current from a power supply. High ohmic resistance is encountered in the early stages of the plasma arc development in the capillary because a small increase in current across the fuse wire requires a substantial increase in voltage.

Furthermore, in the judgement of the applicant, in most prior art concerning electrothermal-chemical gun systems wherein high pressure and temperature plasma is used for ignition and combustion enhancement an exploding or consumable fuse is employed to create a plasma within a container. Heretofore, such fuse wires have encountered several operational problems in regard to high ohmic resistance, geometric consistency of plasma, controllability and repeatability of plasma, and chamber pressure control under given power supply conditions.

The present invention overcomes all of the limitations of the prior art which are attributable to the fuse wire and provides several advances over the prior art. Some of the most important distinguishing features include the use of a filament which has variable cross-sectional area and mass per unit length. Particularly, the filament is constructed to have an infinite adjustment to thereby enable variations in geometric dimensions and mass such that a predetermined ohmic resistance is set to start a plasma arc slowly under the influence of a known power supply. More particularly, by adjusting the filament, a near exact length of plasma arc can be created in a capillary. As will be seen in the ensuing discussions herein below, such a precise control over the dimension of the plasma arc enables control over the energy content, consistency and repeatability of the plasma discharge, and chamber pressure which ultimately results in a precise control over a plasma arc initiated ignition and combustion of a propellant mass to thereby optimize piezometric and ballistic efficiencies.

SUMMARY OF THE INVENTION

Accordingly, some of the central objects of the invention are to provide a method and apparatus wherein plasma arc discharge is controllably developed to ignite and distribute and accelerate plasma-ignited propellant down a gun tube. The plasma arc is generated by high voltage and current discharging through a filament which is configured to provide a stable plasma arc. Particularly, the filament includes geometric and dimensional properties which enable the plasma arc to be stable, consistent and adjustable. The filament is used in cooperation with a perforated capillary to segmentally and strategically distribute plasma into a propellant mass.

Further, the present invention provides a plasma generation apparatus and method which enables to start the plasma arc and the attendant plasma discharge gradually. Unlike fuse wires which explode and create high ohmic resistance, the present invention utilizes a filament which is configured to adjustably provide an ohmic resistance compatible with the power supply and the required plasma arc discharge.

Accordingly, a precision plasma generator and distributor device coupled to a high voltage power supply for use in electrothermal-chemical gun systems is provided. Specifically, a capillary having first and second ends enclosing a volume defined by a wall with the wall having perforations and an elongated filament contained in the capillary and having connections to said first and said second ends, compose the central part of the invention. Further, an anode terminal and a cathode terminal are integrally attached to said first and second ends. A cartridge housing having connections to said anode and said cathode and a combustible chemical mass disposed in said cartridge and surrounding said capillary comprise an external portion of the device.

Further, an electrothermal chemical gun system for generating plasma capable of precise arc creation to control ohmic resistance, arc dimensions and arc consistency and for distributing the plasma into a combustible mass to thereby control rate of combustion is provided. A capillary having a perforated wall defining a volume therein further having proximal and distal ends forms a central portion of the device. A homogenous filament having first and second ends is placed in the capillary. An anode terminal is disposed at said proximal end and is connected to said first end of the filament and a cathode terminal is connected to said second end of the filament. A fuel chamber surrounds the capillary and a chemical chamber is disposed contiguous to said fuel chamber. A nozzle means is used to direct plasma-impregnated fuel into the chemical chamber. Further, a cartridge housing surrounding said fuel chamber and said chemical chamber comprises the outer portion of the device. The cartridge housing also has connections to the anode and cathode terminals.

Furthermore, an electro-thermal chemical gun system having an electric power supply and a plasma generation and distribution system for generating a reliable plasma arc to thereby control the dimension, consistency and energy content of the plasma including a capillary wall having perforations therein and a transverse axis with first and second end, an anode and a cathode terminal disposed at said first and said second ends are provided. A filament having a length with variable geometric sections to adjustably provide variable ohmic resistance to a current discharging along said length and further being coaxially disposed in the capillary and extending between the first and the second ends and being connected to the anode and cathode terminals forms a center portion of the capillary. Moreover, a first combustible chemical chamber surrounds a first segment of the capillary and a second combustible chemical chamber surrounds a second segment of the capillary. A common partition wall is disposed between the first combustible chemical chamber and the second chemical chamber. Orifices with dimensional characteristics for discharging a mixture of plasma-impregnated chemical from the capillary and the first chemical chamber into the combustible chemical are also provided. The outer housing of the device comprises a cartridge for housing the first and second chemical chambers and the anode terminal which is connected to a power supply.

In another aspect of the invention, an improved electro-thermal chemical gun system of the type comprising a power supply, plasma discharge arc across an anode and a cathode terminal including a plasma generation means disposed in a capillary, a combustible chemical chamber means surrounding the capillary and a housing means forming a cartridge having connections to the power supply and a projectile further enclosing the combustible chemical chamber and the capillary are provided. The improvement includes a perforated wall in the capillary defining a volume for confining the plasma discharge arc therein. Further, a tapered filament is disposed in the capillary having an axis of extension and extending between the anode and cathode terminal thereof, wherein a variable ohmic resistance is created along the axis of extension by means of a progressively changing cross-sectional area and mass along the axis. A return circuit is formed at a connection between the cathode terminal and the cartridge.

In yet another aspect of the invention a method of generating a stable plasma discharge arc including a distribution method for said plasma discharge in an electro-thermal chemical gun system containing a capillary with a wall having perforations therein with a plasma generation system contained in said capillary and a cartridge, wherein the capillary and chemical chamber means are contained, connected to a power supply and a projectile being disposed in a gun breech block including the steps of constructing a taper on a filament along an extension axis to thereby create a consistent plasma arc dimension and consistency at a predetermined ohmic resistance along said extension axis are disclosed. Further, installing the filament in the capillary and connecting it to an anode and cathode terminals and energizing the filament by means of high voltage and current at the terminals a predetermined portion of the filament is vaporized to thereby form a continuous plasma arc of a known or knowable dimension.

Furthermore, a method of creating a stable and dimensionally controlled plasma discharge arc at predictable energy levels for a known high voltage source in a capillary having an axis and a wall with apertures defining a volume therein is disclosed. An adjustable, telescoping tapered filament is placed in the capillary. The filament is adjusted to provide a mass and cross-sectional area that is compatible with a desired ohmic resistance. Thereafter, high voltage is introduced from a source and the filament is energized. By maintaining the high voltage, a segment of the filament is vaporized to thereby create and limit plasma within the vaporized segment.

The present invention also provides a method of controlling plasma formation and dimensional characteristics development rate in which the plasma energy content, consistency, and arc dimension are made dependent upon an ablation rate of a filament having an axial length to thereby control combustion of a combustible mass in an electro-thermal chemical gun system. The method includes the introduction of high current and voltage across the axial length of the filament and eroding a segment of the filament until ohmic resistance at the segment reaches impedance levels equivalent to an optimal ratio of the high current and voltage input. Consequently, a plasma arc is formed which is confined within the eroded segments of the filament thereby forming a desired plasma arc dimension with specific energy content and consistency.

DESCRIPTION OF THE PREFERRED EMBODIMENT

The method and apparatus for the precision generator and distributor device for plasma in electrothermal-chemical gun systems disclosed herein includes the advantages of a reliable plasma source with a plasma distribution system that enables a spatial and temporal distribution of plasma into a combustible chemical mass or propellant.

Figure 1:
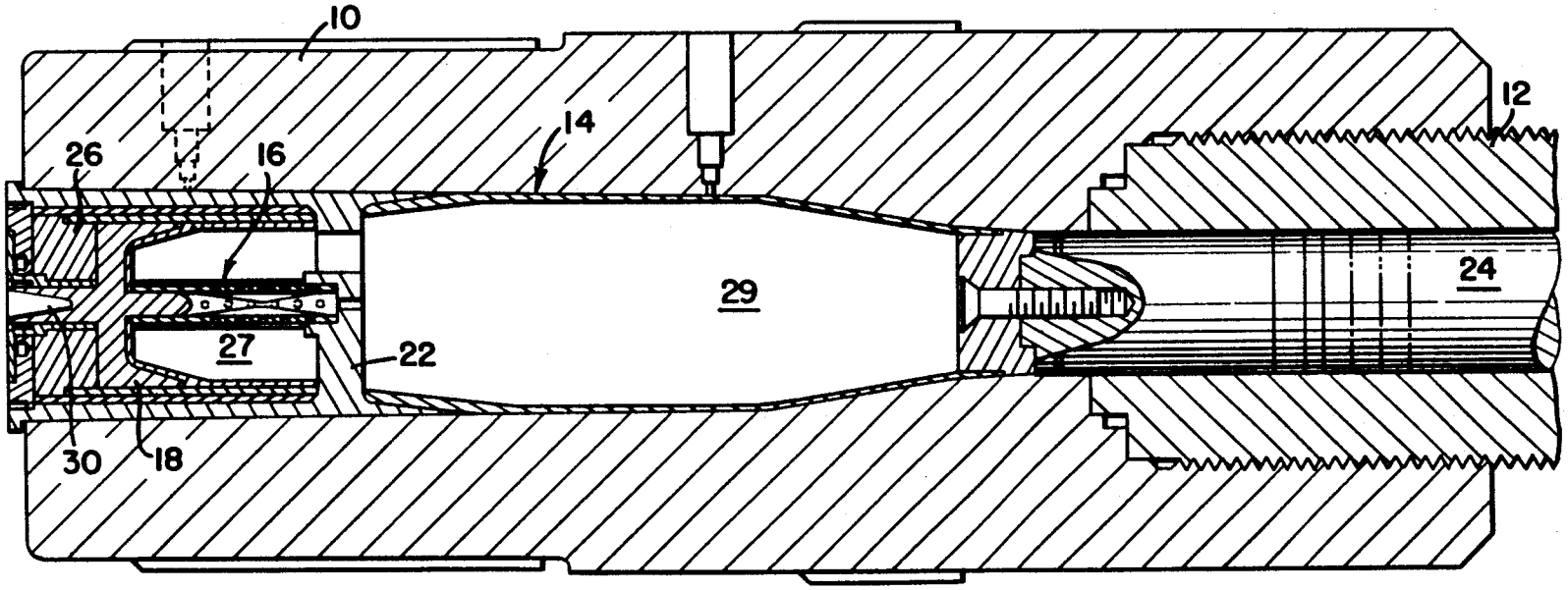
FIG. 1 is a central section depicting a gun breech block with a gun tube where a cartridge comprising chambers and a projectile are disposed.

Referring now to FIG. 1, a chamber 10 is shown integrally attached to a gun tube 12. Further, a cartridge 14 is disposed in the chamber 10. The cartridge comprises a plasma generation and distribution system 16 having connections to an anode cup 18 and a cathode rail 22. The cartridge 14 is connected to a projectile 24 which is disposed in the gun tube 12. Further, a shock absorbing means and a spacer 26 are internally disposed in the cartridge 14. The cartridge 14 also comprises an internal chamber 27 in which a combustible chemical is stored surrounding the plasma generation and distribution system 16. Additionally, a forward chamber 29 in which another combustible chemical or propellant is stored forms a second chamber within the cartridge 14.

In this configuration, power supply is introduced at the anode end 30 (Power supply not shown), and plasma arc and discharge are created in the plasma generation and distribution system 16. The plasma is introduced into the combustible chemical chamber 27 to thereby mix the plasma with the combustible chemical. This mixture of plasma and combustible chemical is introduced into the forward chamber 29 wherein further mixing and combustion take place.

Figure 2:
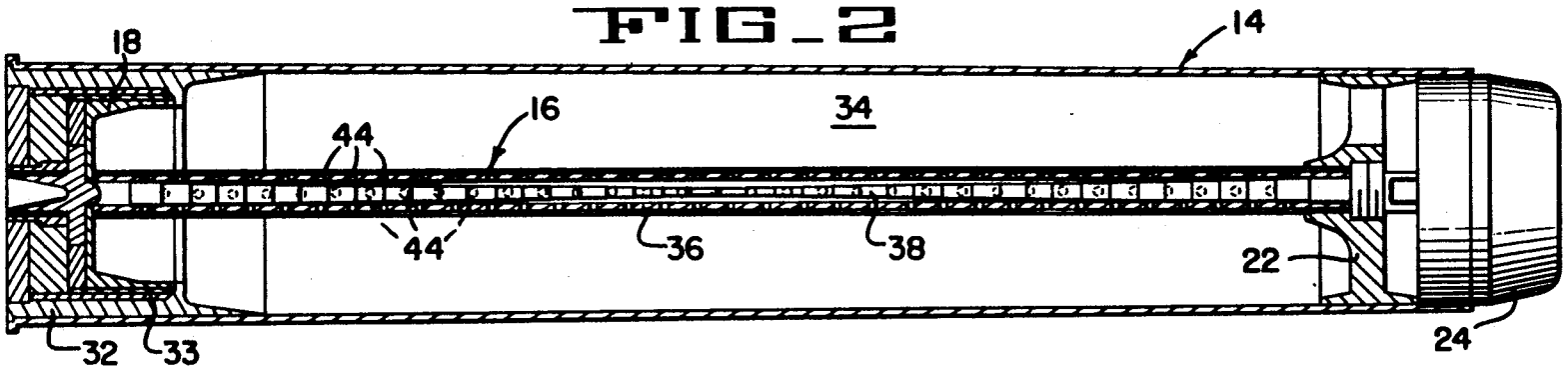
FIG. 2 is a central section of a cartridge depicting a slender monopropellant chamber in which a precision generator and distributor device for plasma is centrally located in addition to a projectile or plug which is integrally connected to the cartridge.

Turning now to FIG. 2, the internal components of a slender cartridge 14 are shown. The slender cartridge 14 comprises a stub case 32, a sleeve 33 inserted in the stub case to integrally contain the anode cup 18 in the cartridge 14. The cartridge further comprises a monopropellant chamber 34 which surrounds the plasma generation and distribution system 16. A cathode rail 22 forms one end of the chamber 34. The plasma generation and distribution system consists a capillary 36 with radial and longitudinal perforations 44 in the wall of the capillary 36. Enclosed within the capillary 36, is a filament 38. The filament 38 is integrally connected to the anode cup 18 and the cathode rail 22 and extends continuously therebetween. The filament 38 is composed of variable cross-sections starting with large cross-sections at the anode 18 and the cathode 22, respectively, with a progressively reducing cross-section at the center to thereby form a central taper. The cartridge is further connected to a projectile 24.

Figure 3:
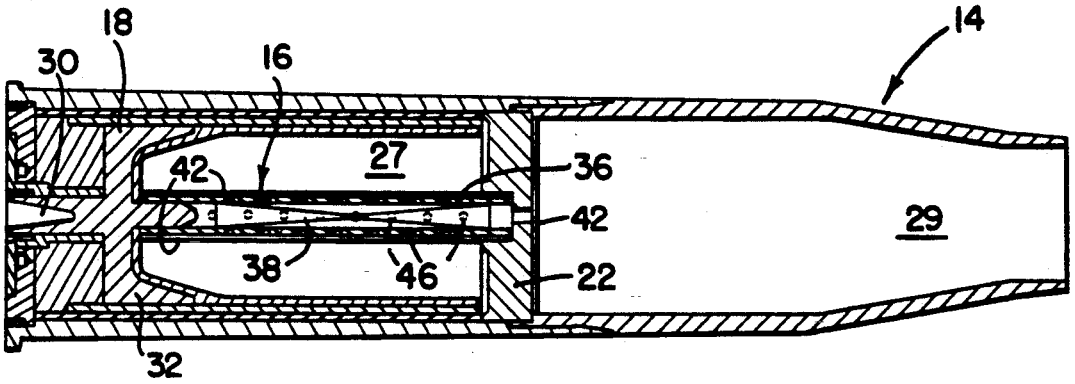
FIG. 3 is a central section of a cartridge showing internal lining layers and propellant chambers inside the cartridge.
Figure 4:
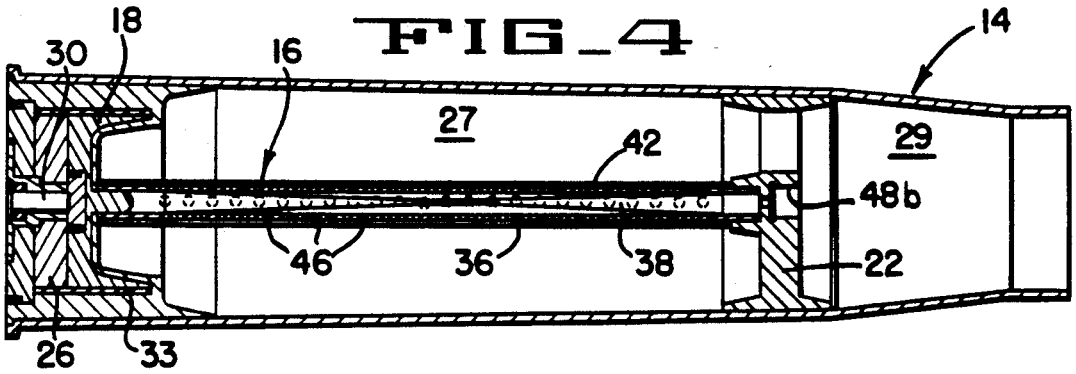
FIG. 4 is a central section of another embodiment depicting a cartridge with slender propellant configuration.
Figure 5:
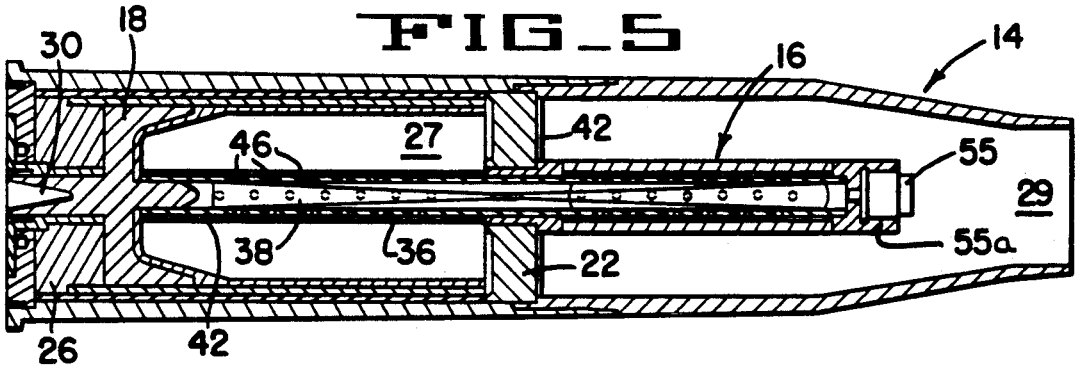
FIG. 5 is a central section of yet another cartridge with the precision generator extending between two propellant chambers.
Figure 6A:
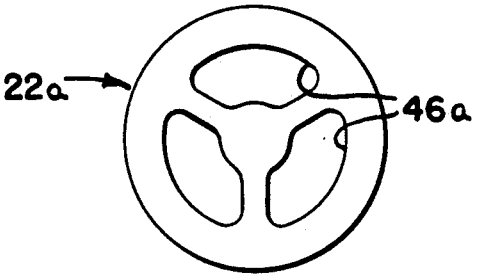
FIG. 6A is a typical view of a plasma distribution nozzle and/or orifice as well as a cathode rail which provides a return current path through the cartridge.
Figure 6B:
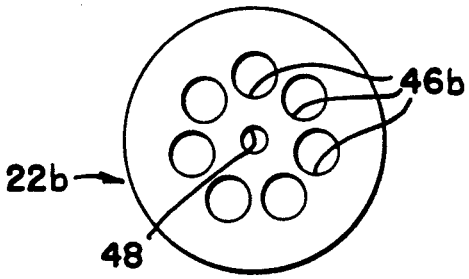
FIG. 6B is a view similar to 6A showing another embodiment of a plasma distribution nozzle and/or orifice as well as a cathode rail which provides a return current path through the cartridge.
Figure 7A:
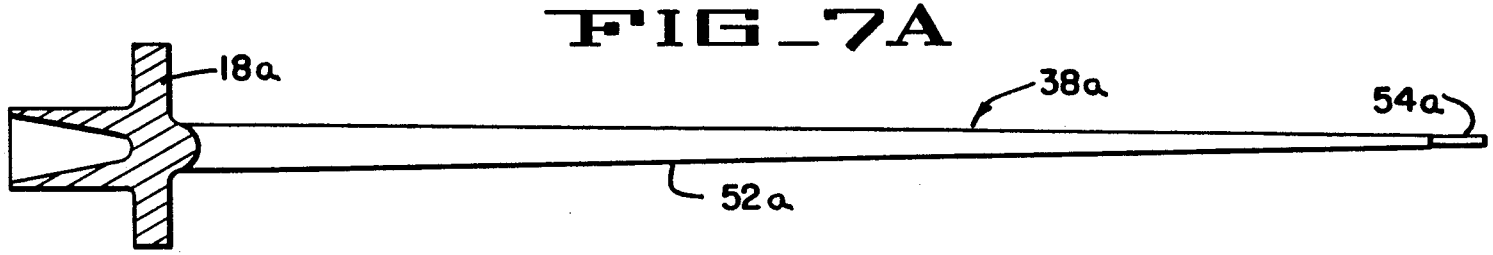
FIG. 7A is a view of a filament connected to an anode terminal.
Figure 7B:
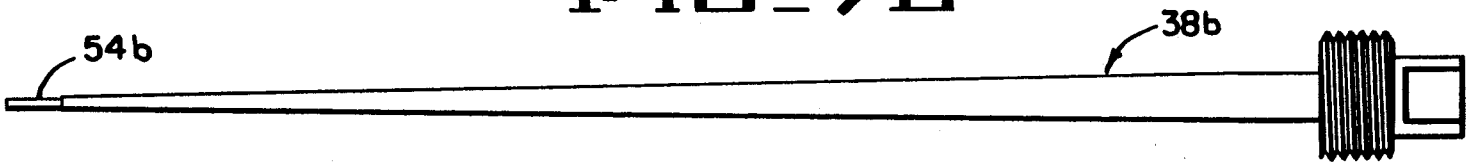
FIG. 7B is a view of a filament connected to a cathode terminal.
Figure 7C:
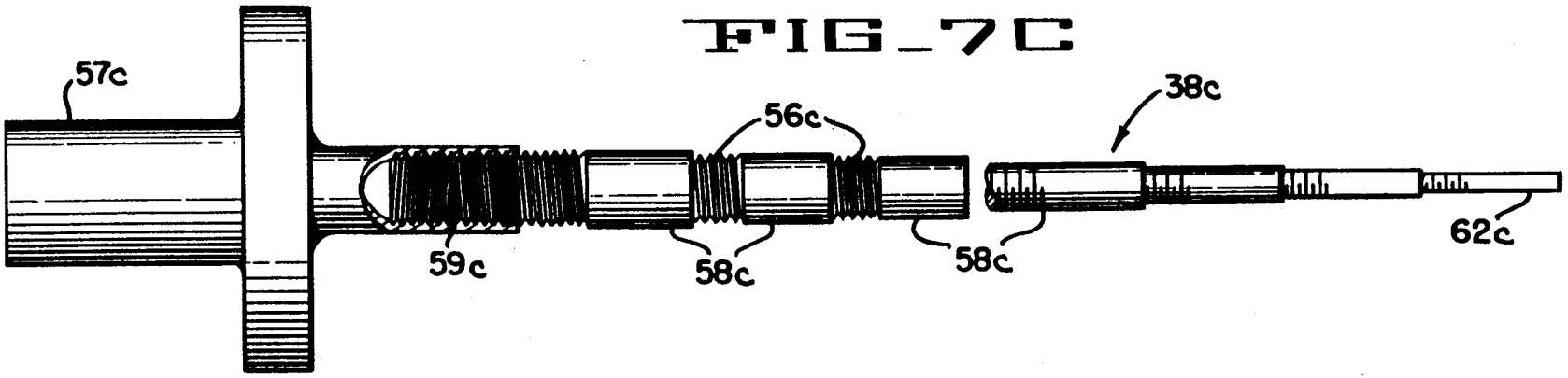
FIG. 7C is a view of a typical filament with adjustably threaded sections for varying the cross-sectional area and mass of the filament.

FIGS. 3, 4 and 5 show cross-sections of cartridges consisting different types and combinations of combustible chemical chambers and plasma generation systems. Referring now to FIG. 3, this structure is conductive to short cartridges to be used in small caliber gun systems, for example, 30 mm and 60 mm guns. The cartridge 14 in FIG. 3, for example, comprises a chemical chamber 27 surrounding the plasma generation and distribution system 16. The combustible chemical in chamber 27 is segregated from the filament 38 by membrane covers 42 which cover the perforations 44 of the capillary 36 from the outside. Moreover, the cathode rail 22 is used as an end cover and a partition wall between the chemical chamber 27 and the adjacent forward chamber 29. Particularly, the cathode rail 22 comprises structures (See FIGS. 6A and 6B) which enable the discharge of plasma-impregnated combustible chemical from the chemical chamber 27 through nozzles or orifices 46. The cathode rail 22 comprises nozzles or orifices 46 which are covered by a membrane cover 42 to keep the contents of the chemical chamber 27 and the forward chamber 29 segregated. The configuration of nozzles 46*a* shown in FIG. 6A is preferred in propellant systems where a large infusion of plasma-impregnated combustible chemical is required to be used to enhance the combustion of chemicals in the forward chamber 29. Comparatively, orifices 46*b* having configurations similar to the one shown in FIG. 6B are used to inject a plurality of plasma-impregnated streams into a propellant mass contained in the forward chamber. This arrangement is best suited for propellants with segmented burning tendencies. More particularly, with reference to FIG. 6B, a central orifice 48 is used to discharge a portion of primary plasma directly into the forward chamber 29. This arrangement is preferred in propellants where initial core ignition is essential to achieve a more complete burning of the propellant.

FIG. 4 shows a cartridge 14 which is adaptable to a larger gun system having a slender chemical chamber 27. The components of this structure are similar to the cartridge shown in FIG. 3. The cathode rail 22, associated with this structure, is similar to the one shown in FIG. 6A wherein a central orifice 48*b* is used to sidestream a portion of the plasma into the forward chamber 29.

FIG. 5 shows a cartridge 14 where the plasma generation and distribution system 16 spans between the chemical chamber 27 and the forward chamber 29. Typically, this structure is conducive to the distribution of plasma in large cartridges for use in large gun systems, for example 155 mm gun systems. Particularly, the arrangement exploits one of the unique advantages of the filament 38. Since, in large gun cartridges, the anode cup 18 and the cathode rail 22 are typically separated by a relatively large distance, the filament 38 of the present invention enables electrical arc to flow and be sustained between the separation distance to thereby enable the distribution of plasma throughout all the chambers of the cartridge 14. Specifically, using the filament 38, electrical arc is controllably directed to flow between the anode cup 18 and the cathode rail 22 with a separation distance greater than 40 times the diameter of the capillary. Heretofore, separation spans between an anode terminal and a cathode terminal of only less than 20 times the diameter of the capillary were the limitations where a fuse wire is used to sustain electrical arc flow. As will be seen in the discussion below, one of the advantages of the filament 38 over the prior art, such as fuse wires, is that the electrical arc initiated and sustained by the filament 38 has a dual function and advantage of being an ignition source and a propellant combustion rate controller.

The operations of the system under a best mode scenario are discussed herein below with particular reference to FIGS. 5, FIGS. 6A & 6B, and FIGS. 7A, 7B & 7C. The filament 38 is shown in different embodiments in FIGS. 7A, 7B and 7C. The filament 38*a* of FIG. 7A comprises an anode cup 18*a*, a tapered segment 52*a* and a frusto-conical tip 54*a*. The cross-sectional area of the filament 38*a* is variable such that the mass per unit length is also variable. Considering now the cartridge in FIG. 5, when power p (not shown) is supplied at the anode end 30, current flows to the cathode terminal 55 which provides a conductive path for the current to flow to the cathode rail 22 which in turn transmits current to the cartridge 14. This arrangement and structure enables the installation of the filament 38 farther out into a forward chamber, such as chamber 29 as in FIG. 5. This in turn enables a highly distributed plasma ignition which, inter alia, is conducive to the enhancement of combustion.

Figure 8:
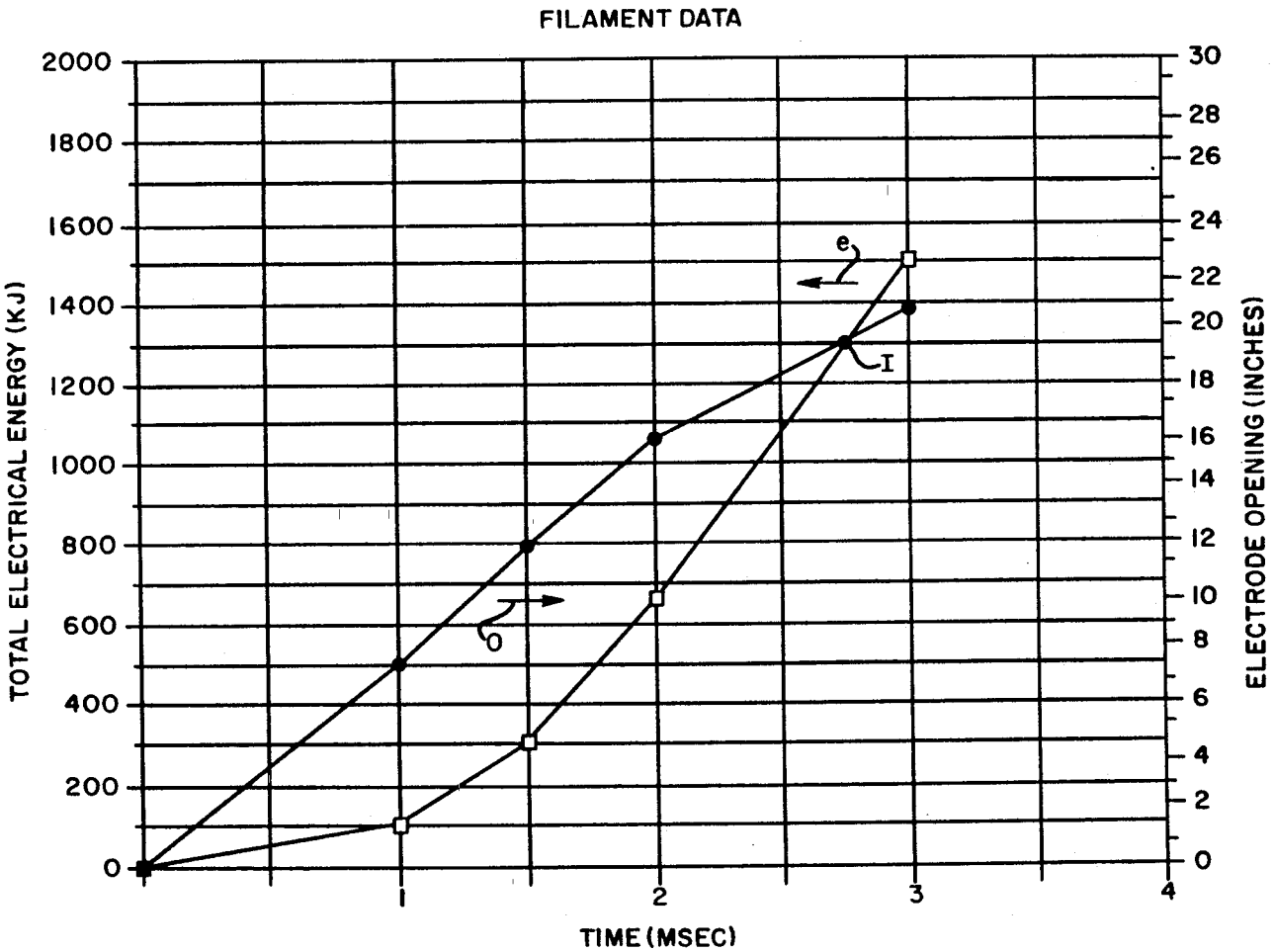
FIG. 8 shows the relationship between the ablated opening in a segment of the filament, in inches, and the energy in Kilo Joules required to effect the ablated opening.

As the electrical energy reaches a certain level, for example 50 Kilo Joules or more, ablation of the filament 38 starts and a portion of the filament is eroded creating a gap at the frusto conical tip 54*a* and 54*b*. As electrical energy increases, the ablative erosion of the filament 38 increases and the opening between filament 38*a* and 38*b* is increased. Particularly, the ablated matter vaporizes forming a plasma arc in the capillary 36. The opening between the filaments 38*a* and 38*b* is dependent upon the energy input and the coefficient of ablation (a ratio of mass per unit energy, e.g. grams per Kilo joules). Further, the coefficient of ablation is dependent on the type of material as well as mass per unit length of the filament 38. Accordingly, one of the unique aspects of the filament 38 in the present invention is the tapered and adjustable structure which enables a variation and adjustment of mass per unit length such that a given electrical energy will be limited to ablating only a predetermined length of filament 38. More particularly, by using the tapered filament 38, the mass per unit length is varied such that the length of plasma arc for a given energy is fixed. This unique feature of the filament 38 provides a significant advance over the prior art where such precise control of the plasma arc length and the attendant geometric dimension is not possible. Specifically, the control over the length of the plasma arc enables the present invention to operate under a broad range of energy levels as well as enables the introduction and distribution of plasma at predetermined segments of a combustible mass located in chambers such as combustible chemical chamber 27 and forward chamber 29. Furthermore, not only the plasma arc length but also the controllability and repeatability of a specific plasma arc comprising specific geometric and energy parameters are achieved through the use of the filament 38 of this invention. Referring to FIG. 8, the relationship between the ablated opening in a segment of a filament, in inches, and the total energy in Kilo joules required to effect the opening are shown. The total energy curve, identified by the arrow "e", rises depicting a steep increase in total energy as the opening in the ablating filament increases. Further, the electrode opening, identified by the arrow "o", increases as the total electrical energy is increased. The two curves intersect at point "I". This point signifies an optimal opening for a given filament for which an increase in energy will not yield a further opening in the filament. Furthermore, both the rate of development and the maximum length of ablated opening in the filament can be controlled by increasing the ohmic resistance along the length of the filament. The present invention accomplishes this objective by varying the mass of the filament such that a specified and knowable length of plasma arc can be created in a capillary such as capillary 36.

Figure 9B:
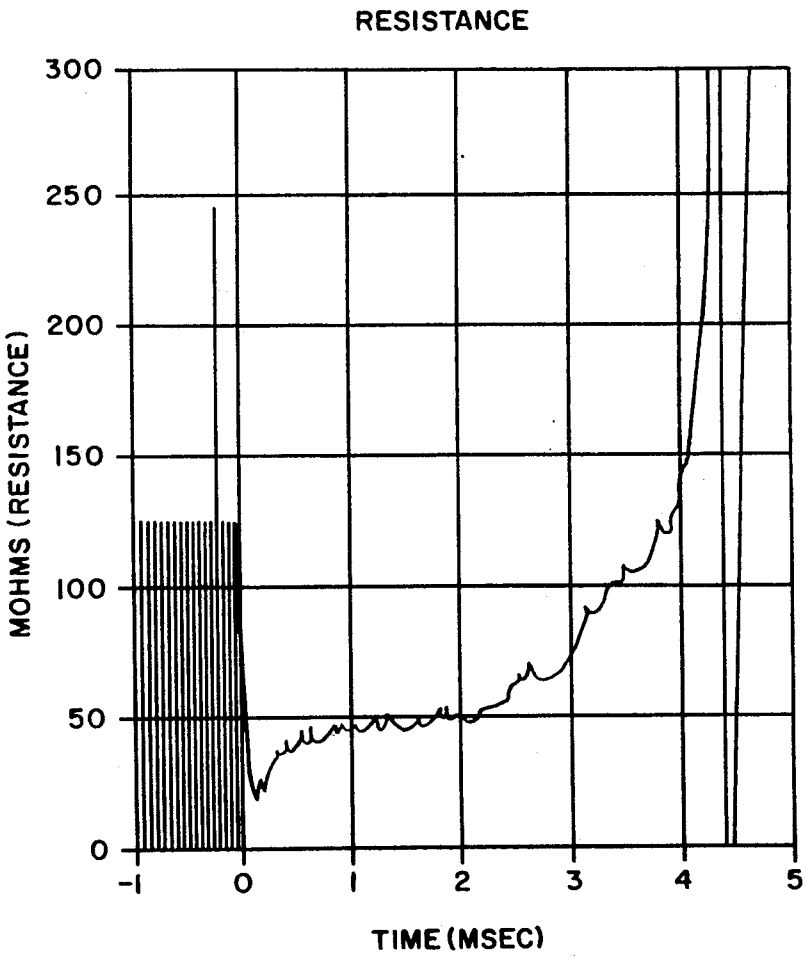
FIGS. 9A & 9B show Power in Megawatts Versus Time in milliseconds and capillary resistance in milliohms Versus Time in milliseconds, respectively.
Figure 9A:
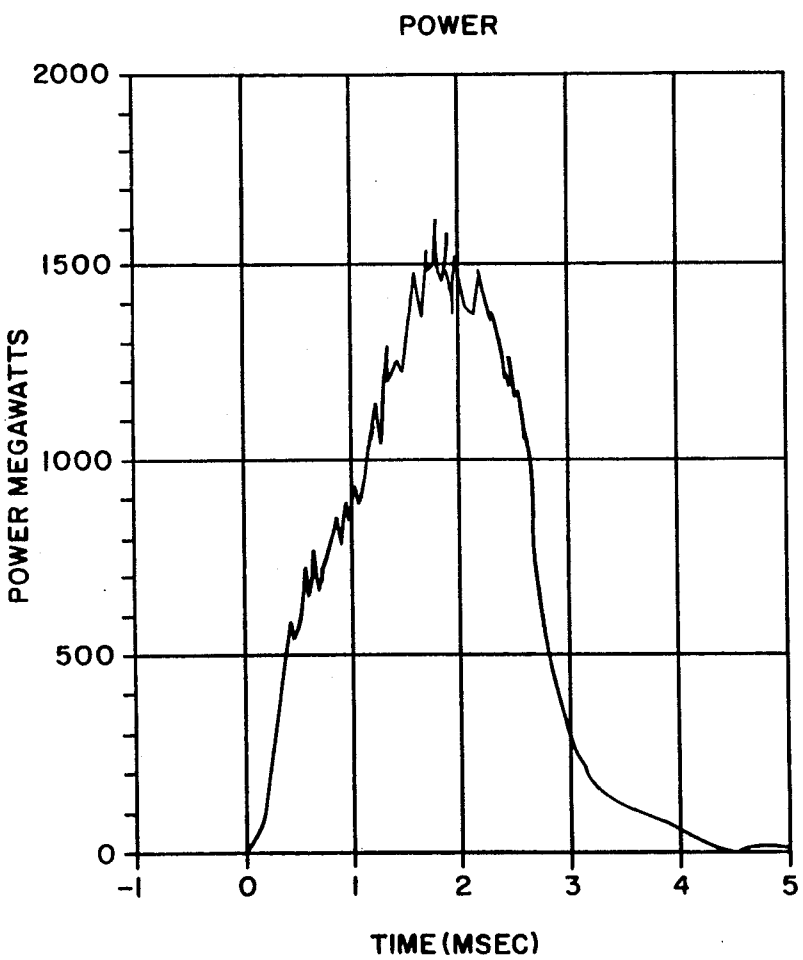
Figure 10B:
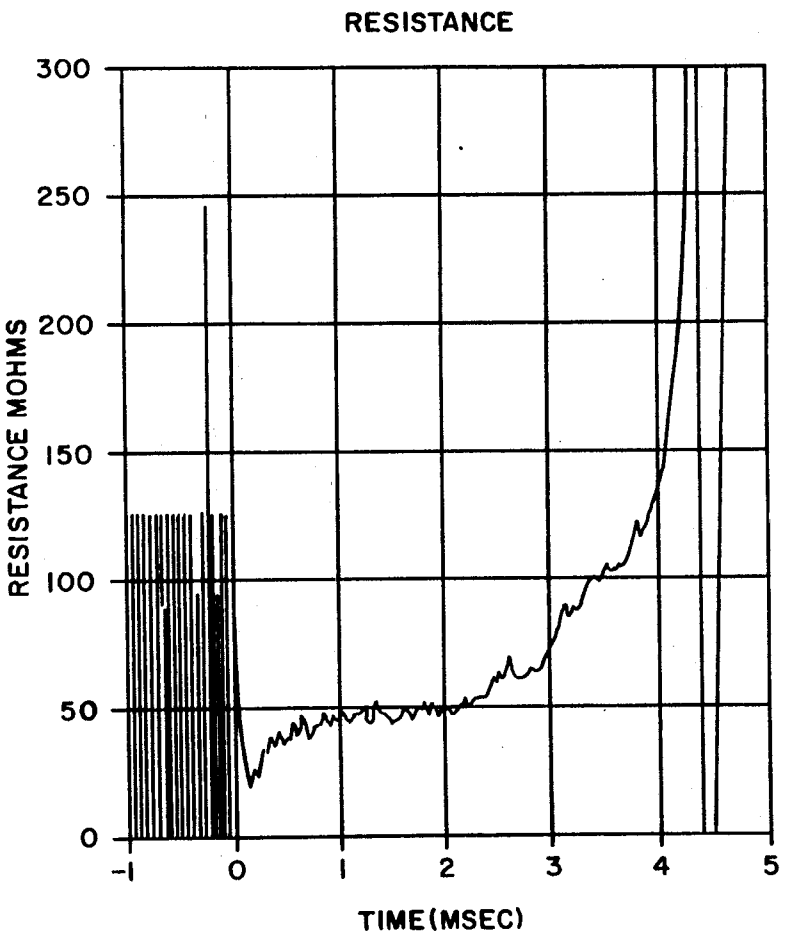
FIG. 10A & 10B show Current in Kilo amps versus Time in milliseconds and resistance in milliohms versus time, respectively.
Figure 10A:
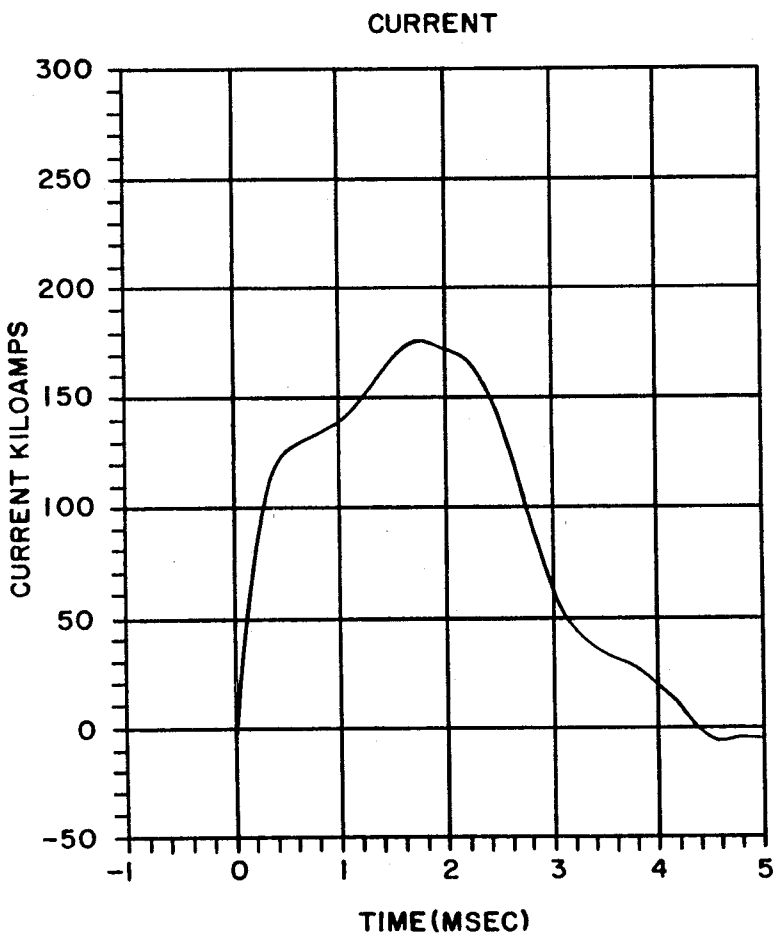

Accordingly, one of the unique aspects of the filament 38 as compared to fuse wires and other conductive media for plasma arc, is that the ohmic resistance can be controlled to be compatible with the energy input. Specifically, as discussed hereinabove, since the rate of development and the length of ablated opening is directly related to the energy input the ohmic resistance is fixed per a given mass and length of filament. More specifically, FIGS. 9A & 9B show power in Mega Watts versus time in milliseconds, and capillary resistance in milliohms versus time in milliseconds. The resistance curve shows a gradual buildup of resistance without any erratic increase in ohmic resistance. Because of initial explosion and the ensuing unpredictable erosion and ablation patterns of fuse wire type plasma generation systems, the ohmic resistance is unpredictably erratic and no reasonable control can be maintained between the power and the ohmic resistance. In sharp contrast to fuse wires, the filament 38 of the present invention, as mentioned hereinabove, has a structure which enables adjustments in mass and length (refer to FIG. 7A, 7B & 7*c*), such that the ohmic resistance can be adjusted to a given power level. Furthermore, as depicted in FIGS. 10A and 10B, the current through the filament 38 is at the peak (at about 2 milliseconds) where the ohmic resistance remains at the lower and nearly stable resistance level of about 50 milliohms (at about 2 milliseconds). Predictably, as the current is reduced, the resistance increases, however, the reduction in current is very gradual thus enabling the elimination of erratic and large ohmic resistance in the plasma generation and distribution system 16 (refer to FIG. 1).

Figure 11B:
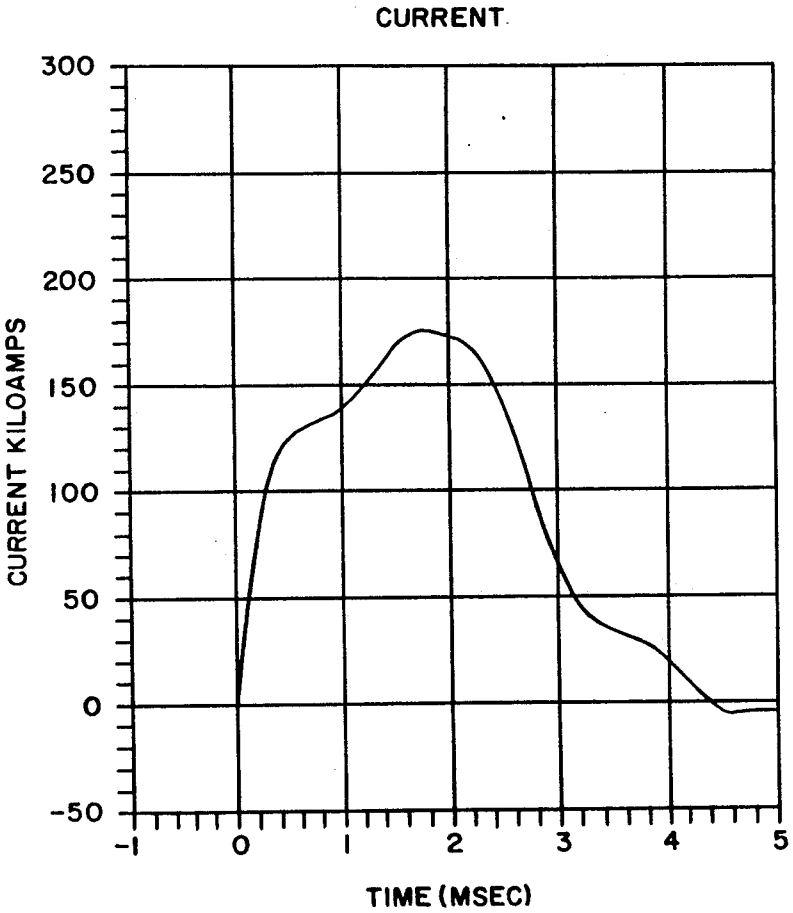
FIG. 11A & 11B show Voltage in Kilo volts versus Time in milliseconds and Current in Kilo amps and Time in milliseconds, respectively.
Figure 11A:
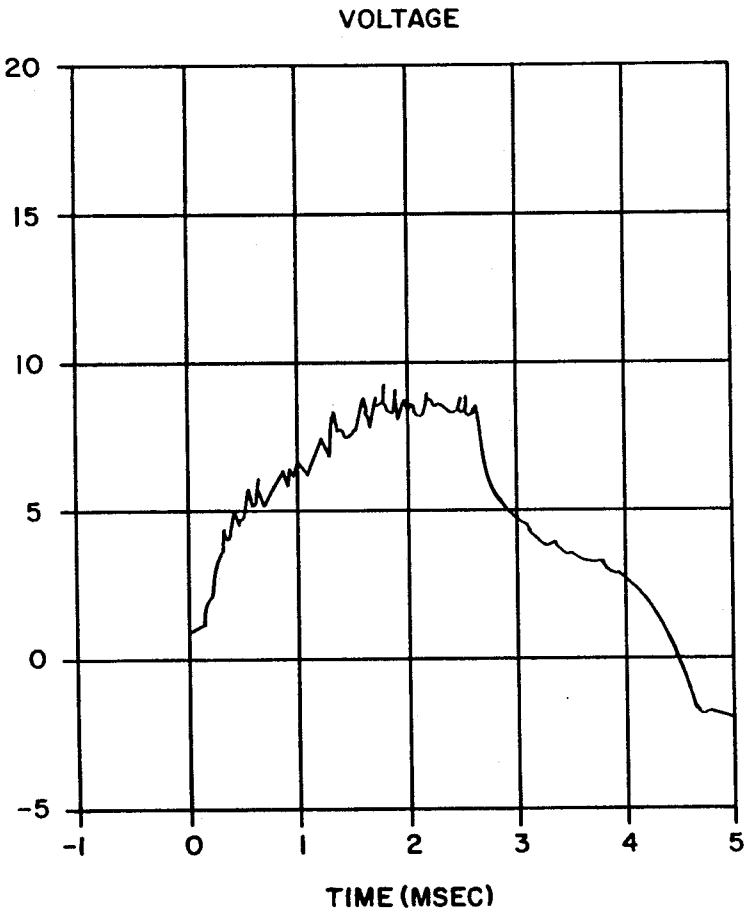
Figure 12B:
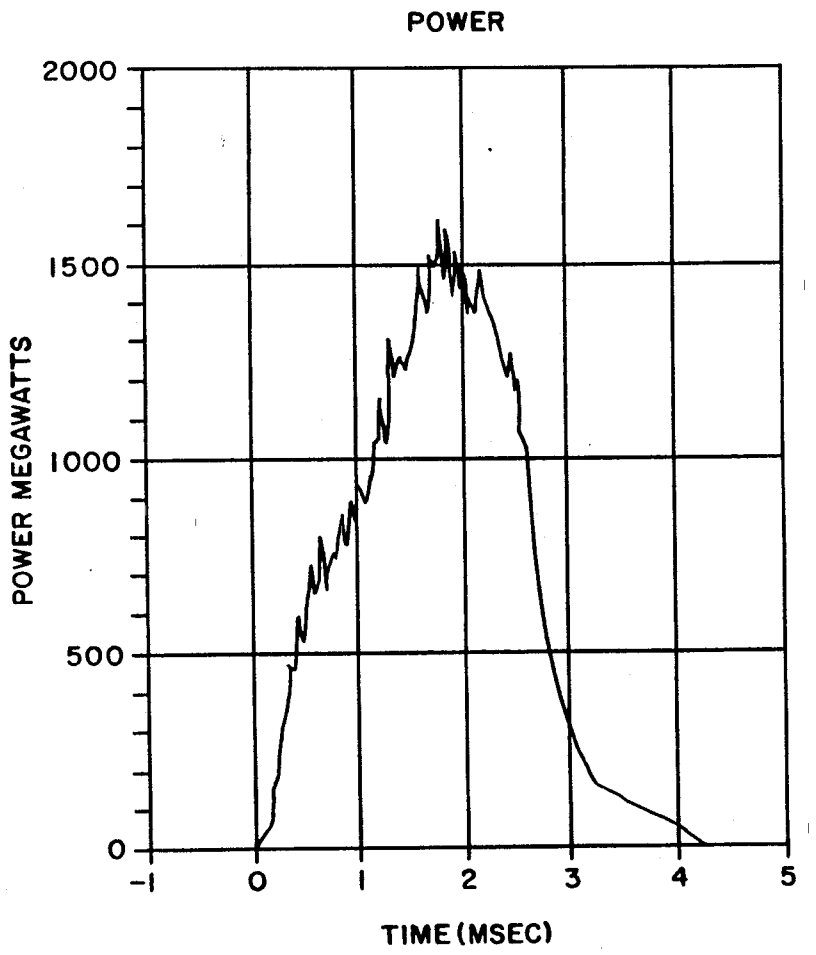
FIG. 12A & 12B show Voltage in Kilo Volts versus Time in milliseconds and Power in Megawatts versus time in milliseconds.
Figure 12A:
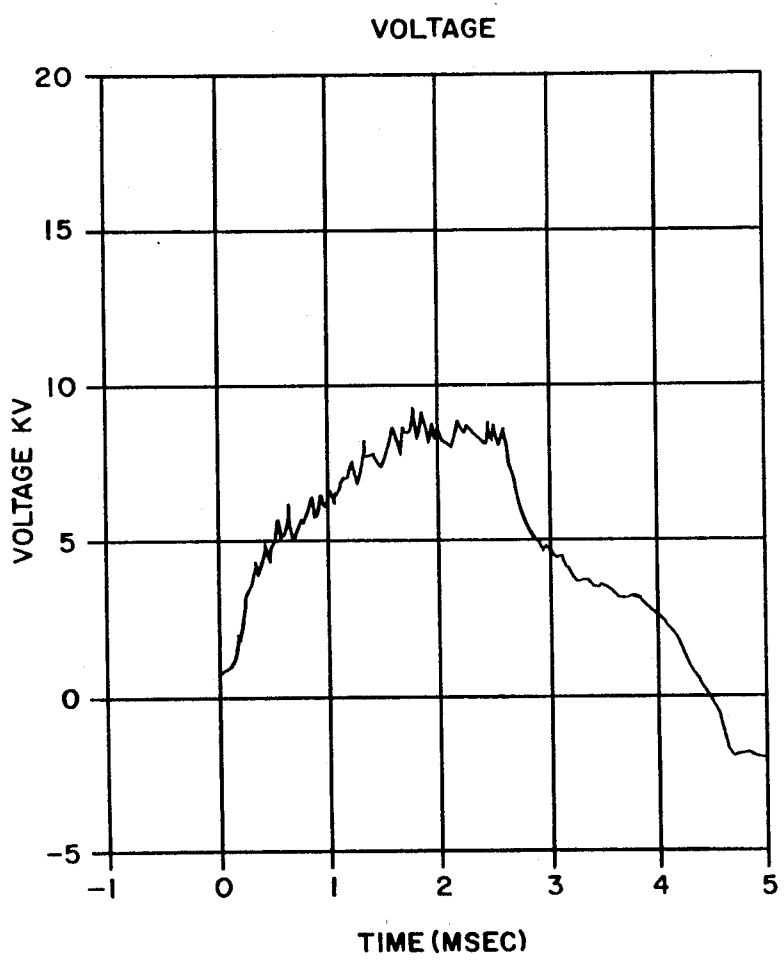

Similarly, FIGS. 11A and 11B show voltage in Kilo volts and current in kilo amps. A comparison of the two curves shows that both the voltage and the current follow a generally increasing and decreasing profile further proving the stable nature of the ohmic resistance of the filament 38 in the capillary 36. Moreover, unlike fuse wires wherein an increase in voltage is associated with a substantial decrease in current, which relationship yields high ohmic resistance, the voltage and current readings in the filament 38 rise and fall in a generally symmetric manner further signifying the advantages of the present invention. Further, FIGS. 12A and 12B depict Voltage (Kilo Volts) and Power (Mega Watts). The power input into the system shows a direct correlation with the Voltage and confirms the fact that the filament 38 is an efficient media for power transfer.

Referring back to FIG. 5, when power P (not shown) is supplied to the cartridge 14 at the anode end 30, electric current travels through the filament 38 which is enclosed in the capillary 36. The current is returned from the cathode end 55 via a metal sleeve 55*a* into the cathode rail 22 which in turn is connected to the cartridge 14. Ultimately, the current is grounded through the gun tube 12, which has a direct contact with the cartridge 14 when a round is set to fire (refer to FIG. 1).

The filament 38 starts to ablate at the tapered or frusto conical end 54, where as discussed hereinabove a gap develops comprising a plasma arc and a plasma discharge. The plasma pressure builds in the capillary 36 until the pressure ruptures membrane covers 42 at perforations 44 in the wall of the capillary 36. Thus, some of the plasma discharge is directed into the combustible chemical chamber 27 and some is directed into the forward chamber 29. When the plasma mixes with the combustible chemical fuel in chamber 27, the chemical is ignited and combustion is initiated with the plasma-ignited burning chemical mass accelerating forward. Particularly, as the plasma pressure is sustained in the capillary 36, by maintaining the power supply, the plasma-ignited burning chemical is pushed forward and impacts the cathode rail 22 comprising nozzles or orifices 46 which are covered by membrane 42. The plasma-ignited burning chemical ruptures the membrane cover 42 and discharges into the forward chamber 29 through the nozzles 46. Similarly, plasma ruptures the membrane covers 42 at the perforations 44 of the capillary 36 thereby igniting the propellant in the forward chamber 29. The mixing rate of the plasma-ignited chemical and the plasma-ignited propellant is controlled by a number of parameters some of the important ones include the location of the taper and the length of the plasma arc, the number of perforations 44 in the capillary 36, the orientation of the plasma arc and the distribution of perforations 44 relative to the chemical chamber 27 and the forward chamber 29, and the shape and size of the nozzles and orifices 46.

The amount of plasma to be distributed into a chamber such as the combustible chemical chamber 27 is particularly dependent upon the length of the plasma arc. Accordingly, by varying the length of the arc the intensity and location of the plasma discharge into the chamber 27 and therefore the combustion therein, can be controlled. This is achieved by adjusting the filament 38 such that a specified ohmic resistance is set for a given power supply. More specifically, by adjusting the mass per unit length of the filament 38, such that only a certain portion is ablatively eroded forming a plasma arc therebetween, a plasma arc having a specific length, location, dimension and intensity can be directed at a predetermined segment of a combustible chemical such as in chamber 27 to supply plasma for ignition. As discussed herein above and with reference to FIG. 7C, the length of the filament 38 and the mass per unit length can be adjustably varied to enable the formation of a plasma arc at various locations within the capillary 36. Each segment of the filament **38*c* is threadably engaged by means of a threaded joint 56*c* to a consecutive segment 58*c*. Thus, each segment includes a thread-accepting hole 59*c* and a threaded end 56*c* with the exception of the end segment 62*c* which includes a first threaded end and a second solid end forming the tip of filament 38*c*. The filament 38*c* is connected to an electrode terminal 57*c***, which may be an anode or a cathode terminal. The embodiment shown in FIG. 7C enables a length and mass adjustment for the provision of plasma having variable length and energy content dependent upon the segments being consumed under specific high current and voltage input.

Figure 13:
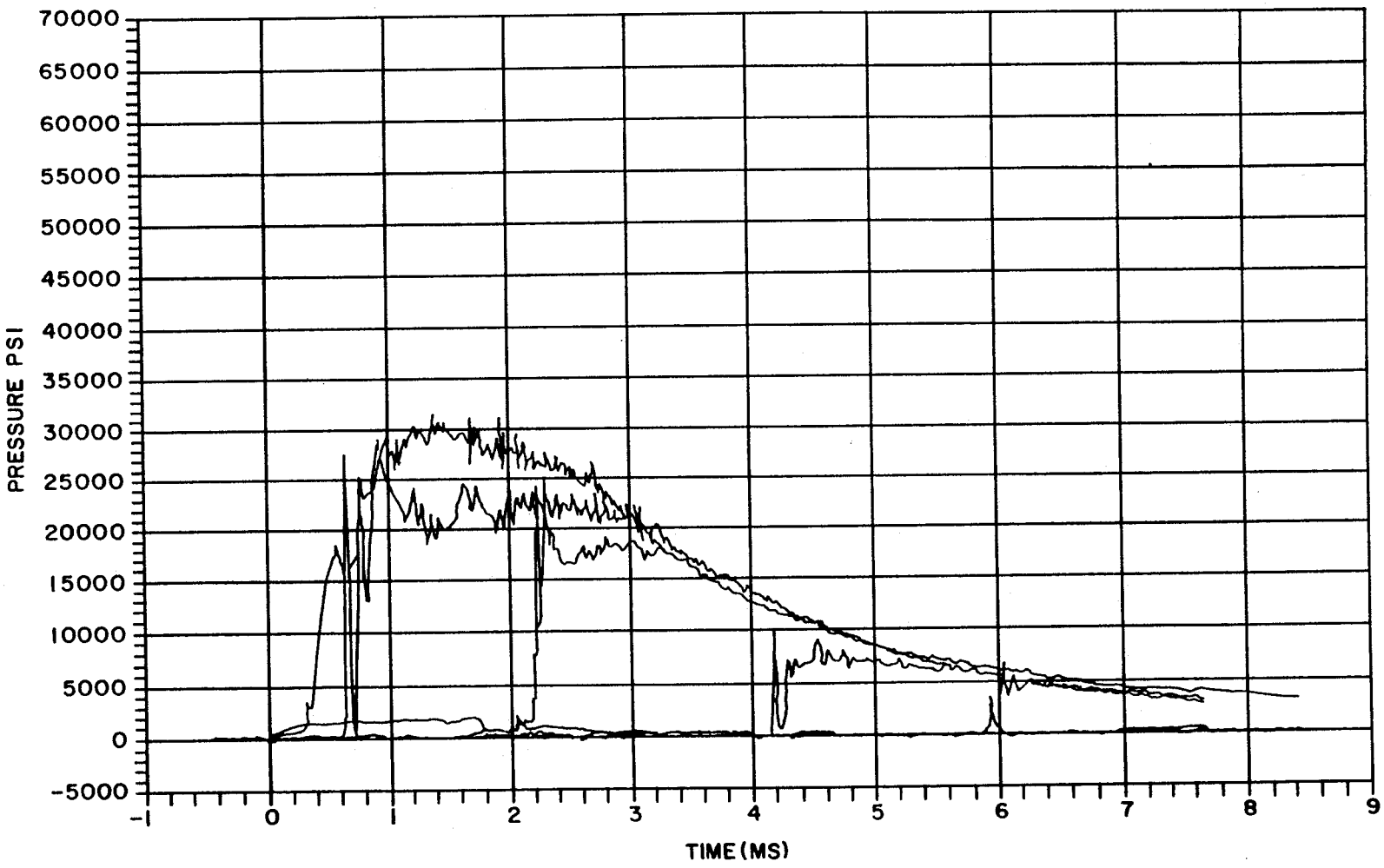
FIG. 13 shows combustion chamber and gun tube pressure in pounds per square inches versus time in milliseconds.
Figure 14:
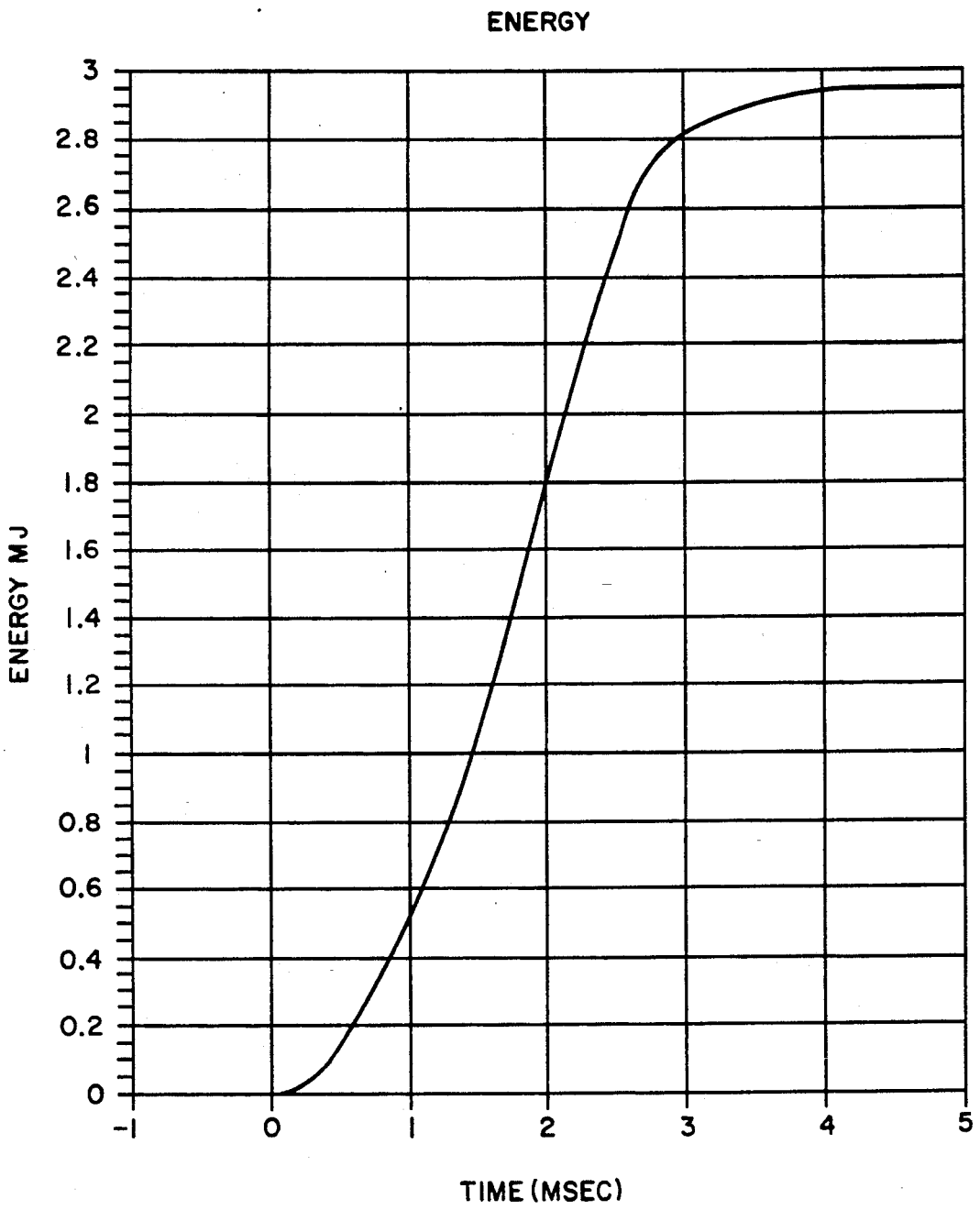
FIG. 14 shows energy in Mega Joules versus time in milliseconds.

After the plasma-ignited chemical from chamber 27 mixes with the plasma-ignited propellant in chamber 29, the high pressure and temperature supplied by the plasma and the attendant combustion of the chemicals and the propellant yield high pressure which accelerates the projectile 24 down the gun tube 12. FIG. 13 shows the pressure at time of ignition and subsequent pressures in the gun tube 12. Initial pressure of 30,000 psi is reached and an energy input of 3.3 Mega Joules yields an output of 2.95 Mega joules (refer to FIG. 14) depicting the high efficiency of the system which is attained as a result of the innovative use of the filament 38 as well as the enhanced combustion attained as a result of the perforated capillary 36.

Accordingly, the device of this invention enables the creation of a reliable and consistent plasma arc with the additional advantages of controllability and repeatability of the system performance. Unlike exploding fuse wires, the present invention enables specific control over the consistency, intensity and dimension of the plasma arc such that the plasma discharge can be tailored to meet the ignition requirements of different types of propellants and gun systems. Further, in cooperation with plasma distribution systems such as the perforations 44 in the capillary 36 and nozzles and orifices 46, the device of this invention can be effectively employed in the strategic ignition and control of a combustible chemical mass.

While a preferred embodiment of the present invention has been shown and described herein, it will be appreciated that various changes and modifications may be made therein without departing from the spirit of the invention as defined by the scope of the appended claims.

What is claimed is:

1. A precision plasma generator and distributor device coupled to a high voltage power supply for use in electrothermal-chemical gun systems comprising:

a capillary having first and second ends enclosing a volume defined by a wall;

said wall having perforations therein;

an elongated filament coaxially disposed in said capillary and further including conical sections forming an axially reduced taper along a longitudinal axis extending from said first end and said second end and forming said taper therebetween;

an anode terminal integrally attached to said first end;

a cathode terminal integrally attached to said second end;

a cartridge housing having connections to said anode and said cathode terminals; and a combustible chemical mass disposed in said cartridge and surrounding said capillary.

2. The device of claim 1 wherein said elongated filament comprises an axially tapering geometric section to create a variable ohmic resistance along a continuous extent of said longitudinal axis of said elongated filament.

3. An electrothermal-chemical gun system for generating plasma capable of precise arc creation to control ohmic resistance, arc dimensions and arc consistency and for distributing the plasma into a combustible mass to thereby control rate of combustion comprising:

a capillary having proximal and distal ends:

a homogenous filament coaxially placed in said capillary and further including conical sections forming an axially reducing taper along a longitudinal axis and further having first and second filament ends;

an anode terminal disposed at said proximal end having connections to said first homogenous filament end;

a cathode terminal disposed at said distal end and further having connections to said second homogenous filament end;

a fuel chamber means contiguous to said fuel chamber;

a nozzle means for directing plasma impregnated fuel into said chemical chamber means; and said cartridge housing having connections to said anode and said cathode terminals.

4. The electrothermal-chemical gun system of claim 3 wherein said perforations in said capillary wall are radially and axially distributed along a continuous extent of said homogenous filament.

5. The electrothermal-chemical gun system of claim 3 comprising closed ends at said distal and proximal ends of said capillary and further including a tapered section along a continuous extent of said homogenous filament which forms at least one of said closed ends for deflecting the plasma to thereby create pressure in said capillary and distribute the plasma radially through said perforations.

6. The electrothermal-chemical gun system of claim 5 wherein said closed ends for deflecting the plasma comprise an orifice to sidestream plasma, from a radial flow to a longitudinal flow direction along said longitudinal axis of said homogenous filament, into said chemical chamber to thereby preignite a core mass of said chemical.

7. An electro-thermal chemical gun system having an electric power supply and a plasma generation and distribution system for generating a reliable plasma arc to thereby control the dimension, consistency and energy content of the plasma comprising:

a capillary wall having perforations therein and a transverse axis with first and second end, an anode and a cathode terminal disposed at said first and said second ends respectively;

a filament having a length with variable geometric sections to adjustably provide variable ohmic resistance to a current discharging along said length and further being coaxially disposed in said capillary and extending between said first end and said second end being connected to said anode and said cathode terminals;

a first combustible chemical chamber means surrounding a first segment of said capillary;

a second combustible chemical chamber means surrounding a second segment of said capillary;

a common partition wall between said first combustible chemical chamber means and said second combustible chemical chamber means;

orifices with dimensional characteristics for discharging a mixture of plasma-impregnated chemical from said capillary and said first combustible chemical chamber means into said second combustible chemical chamber means; and a cartridge for housing said first and said second chemical chamber means and said anode being connected to the power supply.

8. An electrothermal-chemical gun system coupled to a power supply of high voltage and current including a plasma generation unit in a capillary wherein the plasma arc is stabilized, symmetric and adjustably self-sustaining comprising:

a capillary wall having perforations therein;

an anode and a cathode terminal disposed at a distal and proximal end respectively of the capillary;

a filament coaxially disposed in the capillary and further including a plurality of telescoping segments forming a generally tapered shape along a longitudinal axis extending from said proximal and distal ends and forming a taper therebetween; and a housing in which the capillary is contained contiguous to a combustible chemical chamber means and said housing further having connections to said anode and cathode terminals.

9. An electrothermal-chemical gun system having an electric power supply and plasma generation and distribution system for generating a reliable plasma arc to thereby control the dimension, consistency and energy content of the plasma in a capillary wherein the plasma arc is stabilized, symmetric and adjustably self-sustaining comprising:

a capillary wall having perforations therein and a transverse axis with first and second ends, an anode and a cathode terminal disposed at said first and said second ends respectively;

a filament, coaxially disposed in the capillary, having an adjustable length forming variable geometric sections to provide a required variable ohmic resistance to current discharging along said length wherein said filament includes telescoping segments of a series of conical sections slidably adjustable in series to be fixed at a predetermined length to thereby provide the required ohmic resistance across said segments; and a housing in which the capillary is contained contiguous to a combustible chemical chamber means and said housing further having connections to said anode and said cathode terminals and to the power supply.

10. An electrothermal-chemical gun system having am electric power supply and plasma generation and distribution system for generating a reliable plasma arc to thereby control the dimension, consistency and energy content of the plasma in a capillary wherein the plasma arc is stabilized, symmetric and adjustably self-sustaining comprising;

a capillary wall having perforations therein and a transverse axis with first and second ends, an anode and a cathode terminal disposed at said first and said second ends respectively;

a filament, coaxially disposed in the capillary, having an adjustable length forming variable geometric sections to provide a required variable ohmic resistance to current discharging along said length wherein said filament includes segments of a series of sections adjustable to provide a stable arc consistent with a required energy content;

said filament further including two pieces having a spatial distance therebetween; and a housing in which the capillary is contained contiguous to a combustible chemical chamber means and said housing further having connections to said anode and said cathode terminals and to the power supply.

11. An improved electro-thermal chemical gun system of the type comprising a power supply, plasma discharge arc across an anode and a cathode terminal including a plasma generation means disposed in a capillary, a combustible chemical chamber means surrounding the capillary and a housing means forming a cartridge having connections to the power supply and a projectile further enclosing the combustible chemical chamber means and the capillary, the improvement comprising:

a perforated wall in the capillary defining a volume for confining the plasma discharge arc therein;

a tapered filament disposed in the capillary, having an axis of extension and extending between the anode and cathode terminals and having connections at the terminals thereof, wherein a variable ohmic resistance is created along said axis of extension by means of a progressively changing cross-sectional area and mass along said axis; and a return circuit formed at a connection between the cartridge and the cathode terminal.

12. The improved electro-thermal chemical gun system of claim 11 wherein said perforations in the capillary wall include a plurality of apertures having separations in a radial and axial orientation.

13. The improved electro-thermal chemical gun system of claim 11 wherein the tapered filament comprises adjustable cross-section and mass along the extension to thereby control ohmic resistance at any point along the axis of extension.

14. The improved electro-thermal chemical gun system of claim 11 wherein the tapered filament comprises segments having a spatial separation therebetween.

15. A method of creating a stable and dimensionally controlled plasma discharge at predictable energy levels for a known high voltage source in a capillary having a longitudinal axis, a first and a second end and a wall with perforations defining a volume therein, and a tapered filament having adjustable segments, connected to said anode and said cathode terminals and coaxially disposed in the capillary wherein the plasma discharge is directed to ignite and pressurize a combustible chemical mass, in a cartridge to thereby generate constant pressure behind a projectile connected to the cartridge comprising the steps of:

adjusting the tapered filament segments to a length, mass and cross-sectional area to provide an ohmic resistance between said anode and cathode terminals;

maintaining a spatial gap in the filament to thereby form opposing segments having connections to the cathode and anode terminals;

introducing high current and voltage across the axial length of the filament; creating a plasma arc at said spatial gap between said filament segments;

eroding a portion of said opposing segments until the ohmic resistance reaches impedance levels equivalent to an optimal ratio of the high current and voltage input; and maintaining the high current and high voltage input to sustain a plasma arc within the spatial gap and the eroded segments to thereby form a plasma discharge.

16. A method of creating a stable and dimensionally controlled plasma discharge at predictable energy levels for a known high voltage source in a capillary having a longitudinal axis, a first and a second end and a wall with perforations defining a volume therein, and a tapered filament having adjustable segments, connected to said anode and said cathode terminal and coaxially disposed in the capillary wherein the plasma discharge is directed to ignite and pressurize a combustible chemical mass to thereby generate constant pressure behind a projectile connected to the cartridge comprising the steps of:

adjusting the tapered filament segments to a length mass and cross-sectional area to provide an ohmic resistance between said anode and cathode terminals;

maintaining a spatial gap in the filament to thereby form opposing segments having connections to the cathode and anode terminals;

adjusting the distance of the segments of said filament from the cathode and anode including said spatial gap between the filament segments to thereby create a plasma discharge arc of a known dimension at a desired location within said capillary;

introducing high current and voltage across the axial length of the filament;

creating a plasma arc at said spatial gap between said filament segments;

eroding a portion of said opposing segments until the ohmic resistance reaches impedance levels equivalent to an optimal ratio of the high current and voltage input; and maintaining the high current and high voltage input to sustain a plasma arc, at said desired location, within the spatial gap and the eroded segments to thereby form a plasma discharge.

17. A method of controlling plasma formation rate and dimensional characteristics development rate for a plasma arc wherein the plasma energy content, consistency, arc dimensions such as arc diameter and axial length are made dependent upon an ablation rate of a filament having an axial length to control combustion of a combustible mass in an electro-thermal chemical gun system comprising the steps of:

introducing high current and voltage across the axial length of the filament;

eroding a segment of the filament until the ohmic resistance at the segment reaches impedance levels equivalent to an optimal ratio of the high current and voltage input; and maintaining the high current and high voltage input to sustain a plasma arc within the eroded segment to thereby form a plasma discharge.

18. A method according to claim 17 wherein said eroding segment of the filament is adjusted to limit the length of the plasma arc to thereby control a spatial distribution of the plasma discharge into the combustible mass.

* * * * *